United States Patent [19]

Hector

[11] Patent Number: 4,910,898

[45] Date of Patent: Mar. 27, 1990

[54] ROTATABLE SIGN CARRYING DEVICE

[76] Inventor: Francis N. Hector, 955 Kingsfield, Cantonment, Fla. 32533

[21] Appl. No.: 349,316

[22] Filed: May 8, 1989

Related U.S. Application Data

[63] Continuation of Ser. No. 54,277, May 26, 1987.

[51] Int. Cl.[4] ..... G09F 11/02

[52] U.S. Cl. ..... 40/479; 40/602

[58] Field of Search ..... 40/603, 602, 606, 484, 40/493, 479, 473, 607, 608, 613; 211/163; 248/425, 186; 403/2; 52/38, 40, 29, 65, 296, 297

[56] References Cited

U.S. PATENT DOCUMENTS

| | | | |
|---|---|---|---|
| 622,115 | 3/1899 | Carlson | 40/479 |
| 1,361,911 | 12/1920 | Schwesinger | 40/602 |
| 1,571,790 | 2/1926 | Camden | 40/479 |
| 1,974,597 | 9/1934 | Berning et al. | 40/479 |
| 2,030,769 | 2/1936 | Slattengren | 40/479 |
| 2,417,122 | 3/1947 | Pearson | 40/479 |
| 3,579,880 | 5/1971 | Murphy | 40/607 |
| 3,638,341 | 2/1972 | Holmes | 40/602 |
| 3,921,813 | 11/1975 | Cimino | 211/163 |
| 4,253,576 | 3/1981 | Ford et al. | 211/163 |
| 4,503,631 | 3/1985 | Kelly | 40/602 |

*Primary Examiner*—Gene Mancene
*Assistant Examiner*—Michael Lynch
*Attorney, Agent, or Firm*—George A. Bode

[57] ABSTRACT

A sign carrying device having a rotatable super-structure with panels pivotally mounted therein and which pivot in response to wind pressure applied on their surfaces. A footing has a base section mounted therein which rotatably receives an upper section with the superstructure mounted thereon. Shear pins placed between the upper and base sections prevent rotation of the upper section until a predetermined rotational torque is placed thereon. The superstructure mounted on the upper section has a plurality of panels pivotally mounted thereon with spring hinges which allow deflection of the panels in response to wind pressure on the panel surfaces to allow the wind to pass through the superstructure and reduce the risk of damage to the device. The spring hinges cause the panels to return to their normally closed position when there is little or no wind.

18 Claims, 2 Drawing Sheets

ROTATABLE SIGN CARRYING DEVICE

This is a continuation of application Ser. No. 07,054,277, filed May 26, 1987.

BACKGROUND OF THE INVENTION

1. Field of the Invention

The present invention is generally relates to outdoor advertising structures and more particularly to such a rotatable and hinged structure.

2. General Background outdoor structures such as billboards or signs used for advertising or as information or warning signs are used in a variety of locations such as on the tops of buildings, along roadsides, and at construction sites. Such structures are constantly subjected to wind from varying directions and of greatly varying velocities. Such varying conditions have necessitated that many structures be provided with substantial reinforcement to prevent damage to the structure by high velocity winds. This results in bulky structures which are expensive to manufacture and maintain. Applicant is aware of the following outdoor structures which have attempted to address similar problems.

U.S. Pat. No. 3,321,160 entitled "Rotatable Pole Base Construction" discloses a base construction for a pole permitting relative rotation between the pole and the pole foundation so that an arm mounted on an upper portion of the pole may be swung to a different position.

U.S. Pat. No. 3,645,057 entitled "Base For Mounting A Traffic Light Pole In Rotatable And Vertically Adjustable Relation" discloses the combination of projecting pole flanges and opposing supporting and clamping members adjustable over the anchor bolts.

U.S. Pat. No. 3,521,390 entitled "Signboard Wind Load Limiting Apparatus" discloses an apparatus for protecting signboards from wind damage and allowing the use of supporting columns consisting of a signboard frame having a pivot upon which one or more signboard panels is mounted for movement on an axis located closer to one side of the panel than the other and a releasable load limiting lock connected between the panel and the framework for normally holding the panel in a fixed position and for releasing the signboard when the wind loading exceeds a predetermined value.

U.S. Pat. No. 4,503,631 entitled "Blow-Through Pivotal Sign" discloses a signboard attached to a support structure to allow the signboard to rotate along a horizontal or vertical axis and a mechanism for retaining the signboard in a fixed position until a preselected torque due to wind load is applied, as well as a wind responsive retractor for retracting the retaining mechanism to prevent damage thereto after the signboard has been deflected from the fixed position and is swinging freely.

U.S. Pats. No. 2,454,648; 4,544,125; 3,899,843 and 2,048,818 disclose the use of springs that give way in the wind to prevent damage to the sign.

U.S. Pat. Nos. 3,638,341 and 1,242,429 disclose the use of wind spillways to allow the wind to pass through the sign.

SUMMARY OF THE INVENTION

The present invention solves the aforementioned problems in a simple and straightforward manner. What is provided is a signboard having a cylindrical base section mounted in a footing. An upper cylindrical section telescopically fits into the base section for rotation therein. Bearings provided in a first collar at the top of the base section and in an annular groove provided in the bottom of the upper section mate respectively with a similar second collar on the upper section and an annular groove provided in the interior surface of the base section to allow rotation of the upper section relative to the base section with a minimum of friction. A superstructure mounted at the top of the upper section provides surfaces to which signs are mounted for display and is formed from a plurality of panels which are pivotally mounted to the frame of the superstructure. The panels are provided with spring hinges at their pivotal mounts to allow limited deflection of the panels in response to wind against the panels. The wind is allowed to pass between the panels without damage to the signboards and yet effectively maintain the panels in a sufficiently close relationship so that the sign is still easily readable. Shear pins provided between the base section and upper section shear away when a predetermined wind load is placed on the sign to allow rotation of the upper section and superstructure relative to the base section to a position wherein the wind will not cause damage to the signboard.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
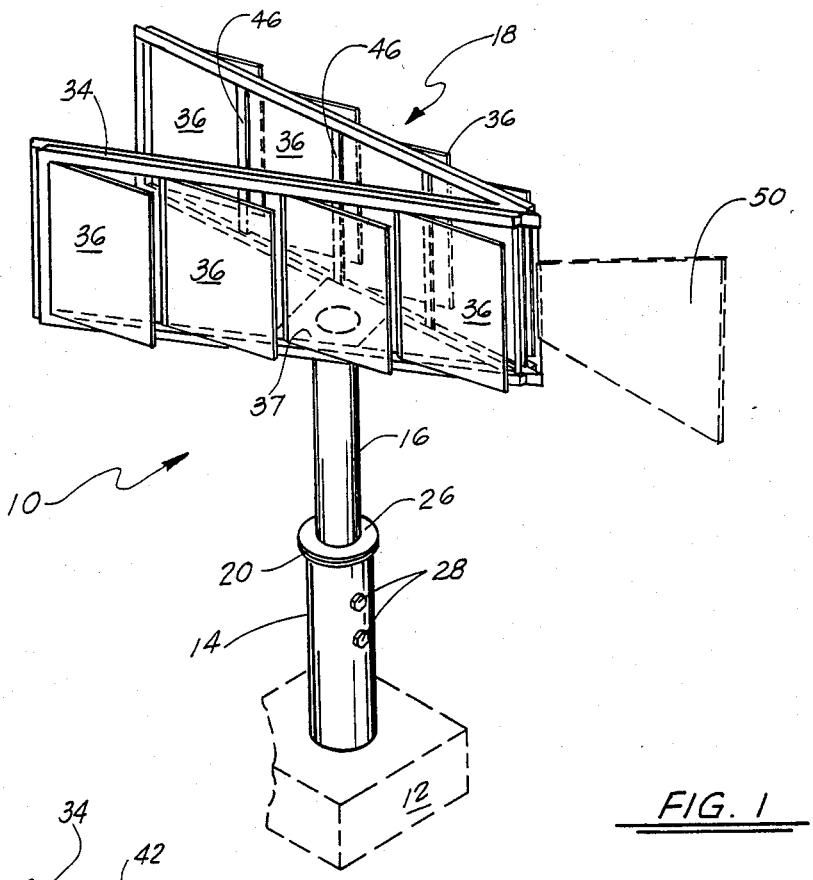
FIG. 1 is a perspective view of the apparatus of the present invention.

Referring now to the drawings, it is seen in FIG. 1 that the apparatus of the present invention is generally referred to by the numeral 10. Rotatable sign carrying device 10 is generally comprised of footing 12, cylindrical base section 14, cylindrical upper section 16, and superstructure 18.

Figure 5:
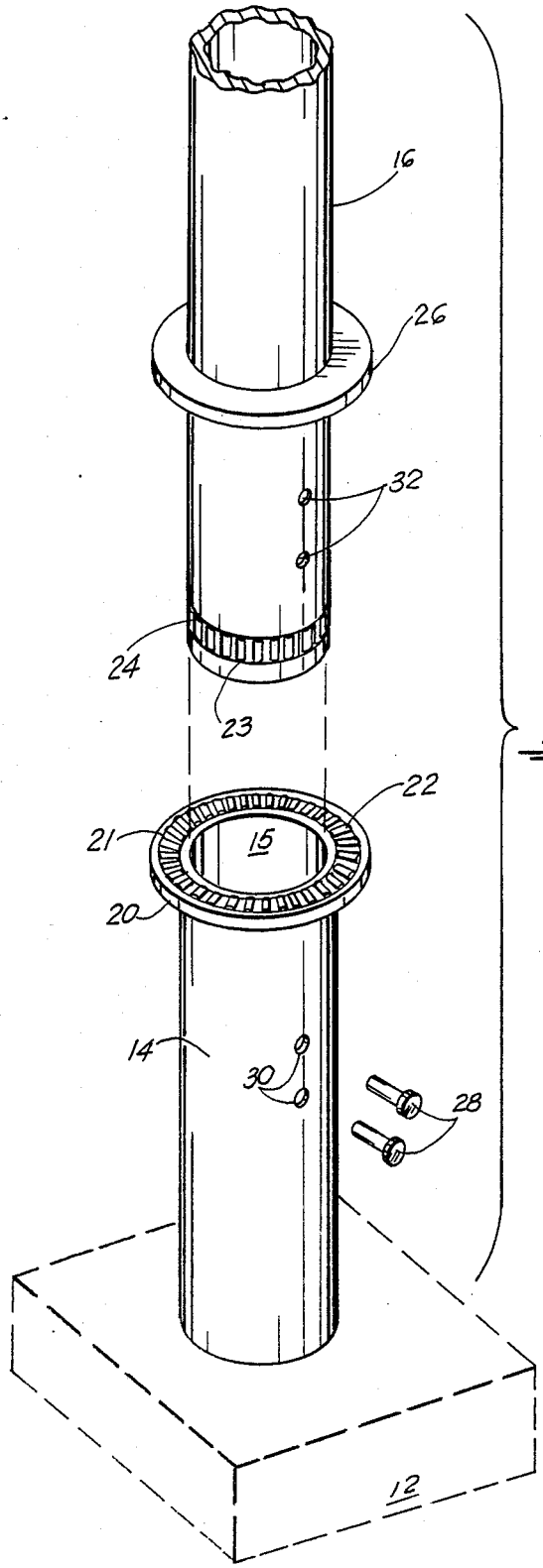
FIG. 5 is an enlarged partial view of the apparatus of FIG. 1 illustrating the base and upper cylindrical sections.

Footing 12, best seen in FIGS. 1 and 5, is illustrated as being square, but may be any suitable shape, such as rectangular, to suit the terrain or area where device 10 is placed. In the preferred embodiment, footing 12 is constructed from a suitable heavy material such as concrete to prevent device 10 from being tipped over during windy conditions. Base section 14 is rigidly mounted in footing 12 by any conventional means such as casting the wet cement around base section 14.

Base section 14, best seen in FIGS. 1 and 5, is cylindrical in cross-section and provided with first collar 20 which extends radially around the upper end of base section 14. Collar 20 may be formed as an integral part of base section 14 or may be a separate piece attached to base section 14 by any conventional means such as welding. Collar 20 has roller means mounted in an annular groove 21 therein such as first set of bearings 22 which face upwardly and away from footing 12. As best seen in FIGS. 1 and 5, base section 14 is hollow for telescopically, slidably and rotatably receiving upper section 16. Upper section 16 is best seen in FIGS. 1 and 5 and, as base section 14, is cylindrical in cross-section and sized to be telescopically received by base section 14. Upper section 16 is provided with roller means such as second set of bearings 24 in an annular groove 23 adjacent its lower end which contact the interior surface 15 of base section 14 and serve to reduce friction between the sections 14, 16 during rotation of upper section 16 relative to base section 14. Upper section 16 is provided with second collar 26. Second collar 26 is positioned a sufficient distance from the bottom of upper section 16 to allow insertion of upper section 16 into base section 14 so that the two sections 14, 16 overlap and provide support and stability to each other, add strength to the sections and prevent upper section 16 from easily tipping out of base section 14. Second collar 26 extends radially from upper section 16 and may be integral therewith or a separate piece attached by any conventional means such as welding. When upper section 16 is inserted in base section 14, second collar 26 comes into contact with first set of bearings 22 in first collar 20 to reduce friction during rotation of upper section 16 relative to base section 14.

Means for releasably preventing rotation of upper section1 6 relative to base section 14 until a predetermined torque is created therebetween is provided in the form of shear pins 28 which extend horizontally through bores 30 and 32, respectively in base section 14 and upper section 16. Although not shown, in an alternate embodiment shear pins 28 may be positioned vertically through collars 20 and 26 instead of through the sections as illustrated. Upper section 16 has superstructure 18 rigidly mounted thereon and discussed further hereinbelow.

Superstructure 18 is comprised of substantially V-shaped frame 34 having a plurality of panels 36 pivotally mounted therein. Panels 36 may be formed from any suitable material such as solid sheets of wood or metal for accepting advertisements thereon. A counterweight or vane 50 may be provided for balancing. Although superstructure 18 is illustrated as being mounted on plate 37 positioned on the top of upper section 16 (plate 37 may be welded to upper section 16), it is not intended to limit the position at which it may be mounted.

Figure 6:
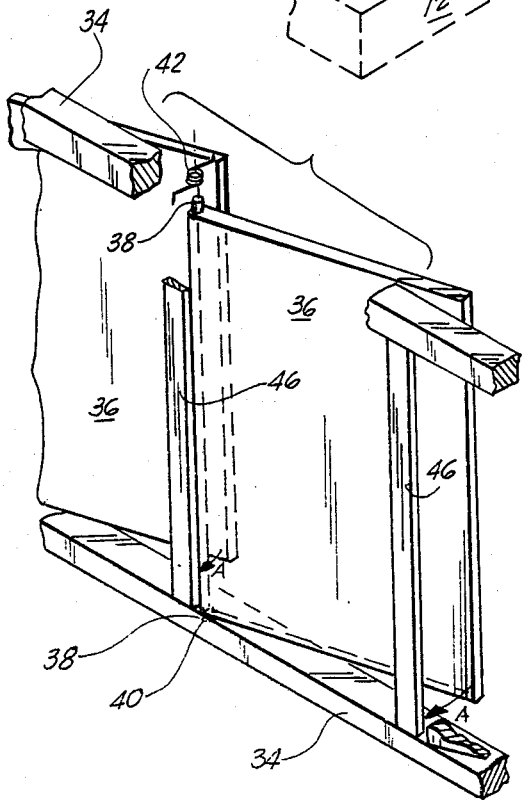
FIG. 6 is an enlarged partial view of the apparatus of FIG. 1 illustrating the mounting and pivotal movement of one of the panels.

FIG. 6 best illustrates the pivotal mounting of one of panels 36 in a normally open position wherein wind is allowed to pass between adjacent panels. For ease of illustration, only one panel 36 is shown and should be considered as representative of all such panels 36. Panel 36 is provided with dowels 38 which extend from the top and bottom edges thereof and are pivotally received by bores 40 in the top and bottom sections of frame 34 (only one of bores 40 is shown for ease of illustration). Means for allowing panel 36 to move between a first normally closed position (of FIGS. 2 and 3) and the second open position (of FIGS. 1, 4 and 6) in response to wind pressure and return to the first normally closed position upon the reduction of wind pressure is provided in the form of spring hinges 42. Spring hinges 42 may be of any suitable type known in the art and in the preferred embodiment have a coiled center section which fits over dowels 38 and two opposing arms which contact frame 34 and panel 36. In this manner, spring hinges 42 maintain panels 36 in their first normally closed position (FIGS. 2 and 3) when there is little or no wind pressure against the panels 36, but allows panels 36 to move to their second open position (FIGS. 1, 4 and 6) to allow wind to flow past panels 36. This serves to reduce stress from wind pressure against device 10. The inward movement of panels 36 relative to frame 34 is prevented by vertical connecting posts 46 which are overlapped by panels 36 upon closing (see ARROW A in FIG. 6).

Figure 2:
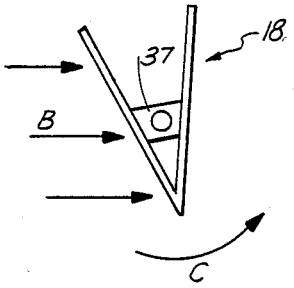
FIG. 2 is a top view of the apparatus of FIG. 1 illustrating the wind direction at a severe angle to the superstructure and causing it to rotate.
Figure 3:
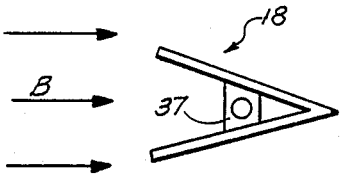
FIG. 3 is a top view of the apparatus of FIG. 1 illustrating the superstructure having rotated in the direction of the wind.
Figure 4:
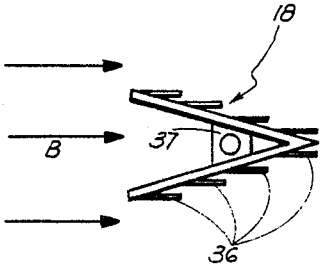
FIG. 4 is a top view of the apparatus of FIG. 1 illustrating the spring hinged panels deflected by the wind.

In operation, rotatable sign carrying device 10 is placed at a suitable location with panels 36 having an advertisement placed thereon. In the event that a strong wind bears against superstructure 18, as indicated by ARROWS B in FIG. 2, a great stress is placed upon device 10 and shear pins 28 will be sheared off by torque between base section 14 and upper section 16. With pins 28 sheared off, superstructure 18 and upper section 16 which are fixedly connected will rotate (in the direction of ARROW C in FIG. 2) relative to base section 14 and into the position illustrated in FIG. 3. As indicated by FIG. 4, the continuing wind pressure causes panels 36 to move between their first normally closed position (FIGS. 2 and 3) and second open position (FIGS. 1 and 4) in response to wind pressure against panels 36 and spring hinges 42. It should also be understood that the operation of panels 36 and spring hinges 42 is equally well in response to wind from any direction and that FIGS. 2-4 is used to also illustrate the operation of shear pins 28 to prevent damage to device 10 during excessive wind blowing.

Because many varying and differing embodiments may be made within the scope of the inventive concept herein taught and because many modifications may be made in the embodiment herein detailed in accordance with the descriptive requirement of the law, it is to be understood that the details herein are to be interpretted as illustrative and not in a limiting sense.

What is claimed this invention is:

1. A sign carrying device, comprising:

a. a base section mounted in a footing;

b. an upper section slidably and rotatably connected to said base section;

c. means for preventing movement of said upper section relative to said base section until a predetermined torque due to wind load is applied; and, d. a sign carrying support structure rigidly mounted on said upper section, having first and second frame portions each having proximate and distal ends, said frame portions being joined at the proximate ends thereof and increasingly divergent longitudinally therealong to the distal ends thereof thus defining a void therebetween, said upper section being further positioned under said void defined between said diverging frame portions, said frame portions having upper, lower and adjacent vertical side members, and a plurality of vertical posts connected to said upper and lower members and spaced therealong, said upper and lower members pivotally accomodating a plurality of sign panels at pivot means provided at first edges thereof in a first position, said sign panels forming wind-engaging means for rotational movement from said first position about said pivotable edges when a pre-determined torque due to wind load is applied.

2. The device of claim 1, wherein said base section is cylindrical in cross-section.

3. The device of claim 1, wherein said upper section is cylindrical in cross-section.

4. The device of claim 1, wherein said means for preventing movement of said upper section relative to said base section comprises shear pin means inserted in aligned bores provided in said base section and said upper section.

5. The device of claim 1, further comprising means for preventing the rotation of said sign panels to second positions inwardly of said frame portions.

6. The device of claim 5 wherein said means for preventing rotation of said sign panels includes said vertical posts engaging the marginal edges of said sign panels opposite said first edges.

7. The device of claim 1 further comprising means for biasing said sign panels to said first position.

8. A sign carrying device, comprising:

a. a base section mounted in a footing;

b. an upper section slidably and rotatably connected to said base section;

c. means for preventing movement of said upper section relative to said base section until a predetermined torque due to load wind load is applied;

d. a sign carrying support structure rigidly mounted on said upper section, having first and second frame portions each having proximate and distal ends, said frame portions being joined at the proximate ends thereof and increasingly divergent longitudinally therealong to the distal ends thereof thus defing a void therebetween, said upper section being further positioned under said void between said diverging frame portions and, said frame portions having upper, lower and adjacent vertical side members, and a plurality of vertical posts connected to said upper and lower members and spaced therealong, said upper and lower members pivotally accomodating a plurality of sign panels at pivot means provided at first edges thereof in a first position, said sign panels forming wind-engaging means for rotational movement from said first position about said pivotable first edges when a predetermined torque due to wind load is applied;

e. means for preventing the rotation of said panels to second positions inwardly of said divergent frame portions; and, f. means for biasing said sign panels to said first position.

9. The device of claim 8, wherein said base section is cylindrical in cross-section.

10. The device of claim 8, wherein said upper section is cylindrical in cross-section.

11. The device of claim 8 wherein said means for preventing rotation of said sign panels includes said vertical posts engaging the marginal edges of said sign panels opposite said first edges.

12. The device of claim 11, wherein said biasing means is a spring.

13. The device of claim 7 wherein said means for preventing movement of said upper section comprises shear pin means inserted in aligned bores provided in said base section and said upper section.

14. A sign carrying device, comprising:

a. a base section mounted in a footing;

b. an upper section telescopically, slidably and rotatably connected to said base section;

c. means for preventing movement of said upper section relative to said base section comprising a plurality of shear pins inserted in aligned bores provided in said base section and said upper section;

d. a sign carrying support structure rigidly mounted on said upper section and having first and second frame portions each having proximate and distals ends, said frame portions being joined at the proximate ends thereof and increasingly divergent longitudinally therealong to the distal ends thereof thus defining a void therebetween, said upper section being further positioned under said void defined between said diverging frame portions, and said frame portions having upper, lower and adjacent vertical side members, and a plurality of vertical posts connected to said upper and lower members and spaced therealong, said upper and lower members pivotally accomodating a plurality of sign panels at pivot means provided at first edges thereof in a first closed position, said sign panels forming wind-engaging means for rotational movement from said first closed position about said pivotable first edges when a pre-determined torque due to wind load is applied;

e. means for preventing the rotation of said sign panels to second open positions inwardly of said frame portions; and, f. means for biasing said sign panels to said first open position.

15. The device of claim 14, wherein said base section is cylindrical in cross-section.

16. The device of claim 14, wherein said upper section is cylindrical in cross-section.

17. The device of claim 14, further comprising:

a. a first collar extending radially from the upper end of said base section;

b. a first set of bearings mounted in an annular groove provided in said first collar;

c. a second collar extending radially from said upper section and which contacts said first bearings when said upper section is telescopically connected to said base section; and d. a second set of bearings mounted in an annular groove in the lower end of said upper section which contact the interior surface of said base section when said upper section is telescopically connected thereto.

18. The device of claim 12 wherein said means for preventing rotation of said sign panels includes said vertical posts engaging the marginal edges of said sign panels opposite said first edges.

* * * * *